United States Patent [19]

Nasgowitz

[11] 4,217,985

[45] Aug. 19, 1980

[54] DISPLAY DEVICE FOR STORING AND DISPLAYING CARDS

[75] Inventor: Donald D. Nasgowitz, Milwaukee, Wis.

[73] Assignee: Display Corporation International, Milwaukee, Wis.

[21] Appl. No.: 905,733

[22] Filed: May 15, 1978

[51] Int. Cl.[2] ..... A47F 7/00

[52] U.S. Cl. ..... 211/50; 40/124.2; 211/88

[58] Field of Search ..... 211/50, 55, 88, 89, 211/49 R, 99; 312/248, 257 A; 248/223.3, 291, 293, 240.1, 240.4; 16/172; 292/DIG. 69; 40/124, 124.2

[56] References Cited

U.S. PATENT DOCUMENTS

| | | | |
|---|---|---|---|
| D. 158,464 | 5/1950 | Hopp | 211/49 R |
| 1,716,038 | 6/1929 | Ferris | 16/172 X |
| 2,541,942 | 2/1951 | Sherman | 16/172 X |
| 2,879,899 | 3/1959 | Shenkin | 211/55 |
| 3,182,945 | 5/1965 | Sedo | 248/242 |

*Primary Examiner*—William E. Lyddane

[57] ABSTRACT

A display device for storing and displaying a plurality of cards includes a supporting structure having a generally vertical wall, and display rack supported by the vertical wall and having an upper portion and a lower portion. The display rack includes a planar dividing wall having a front face and a rear face, a plurality of adjacent display compartments supported by the front face, and a plurality of storage compartments supported by the rear face for supporting cards therein. The display device also includes means for supporting the display rack in a first position adjacent the vertical wall, and a second forwardly inclined position wherein the upper portion of the display rack is spaced from the vertical wall and the lower portion is positioned adjacent the vertical wall, the supporting means including at least one hook projecting rearwardly from the display rack and engageable with the vertical wall when the display rack is in the second position.

8 Claims, 4 Drawing Figures

DISPLAY DEVICE FOR STORING AND DISPLAYING CARDS

BACKGROUND OF THE INVENTION

The present invention relates to display devices for use in retail establishments and the like as point of purchase displays. More particularly, the invention relates to a display device having compartments for displaying stacks of cards such as paint chip sample cards and also including readily accessible storage compartments for storing additional sample cards to be used to refill the display compartments.

SUMMARY OF THE INVENTION

The invention includes a display device for storing and displaying a plurality of cards, the display device including a supporting structure having a generally vertical wall and a display rack supported by the vertical wall. The display rack includes a planar dividing wall having a front face and a rear face, a plurality of adjacent display compartments supported by the front face, and a plurality of storage compartments supported by the rear face for supporting cards therein. The display device also includes means for supporting the display rack in a first position adjacent the vertical wall, and a second forwardly inclined position wherein the upper portion of the display rack is spaced from the vertical wall and the lower portion is positioned adjacent the vertical wall. The supporting means includes at least one hook projecting rearwardly from the display rack and engageable with the vertical wall when the display rack is in the second position.

One of the principal features of the invention is the provision in the vertical wall of at least one aperture and wherein the hook is attached to a lower portion of the display rack and extends rearwardly and downwardly and through the aperture.

Another of the principal features of the invention is the provision in the hook of an arm portion attached to the display rack and inclined downwardly and rearwardly, the arm portion including a free end extending through the aperture and a hook portion attached to the free end of the arm portion, the hook portion extending downwardly and transversely with respect to the arm portion and engaging the vertical wall when the display rack is in the second position.

Another of the principal features of the invention is the provision in the vertical wall of at least a pair of vertically spaced apertures therein including an upper aperture and a lower aperture, and the provision in the means for supporting the display rack of a projection extending rearwardly from the tray and spaced upwardly from the hook, the projection positioned in the upper aperture when the supporting means is in the first position and spaced from the vertical wall when the tray is in the second position, and the hook being positioned in the lower aperture.

DESCRIPTION OF THE PREFERRED EMBODIMENT

Figure 1:
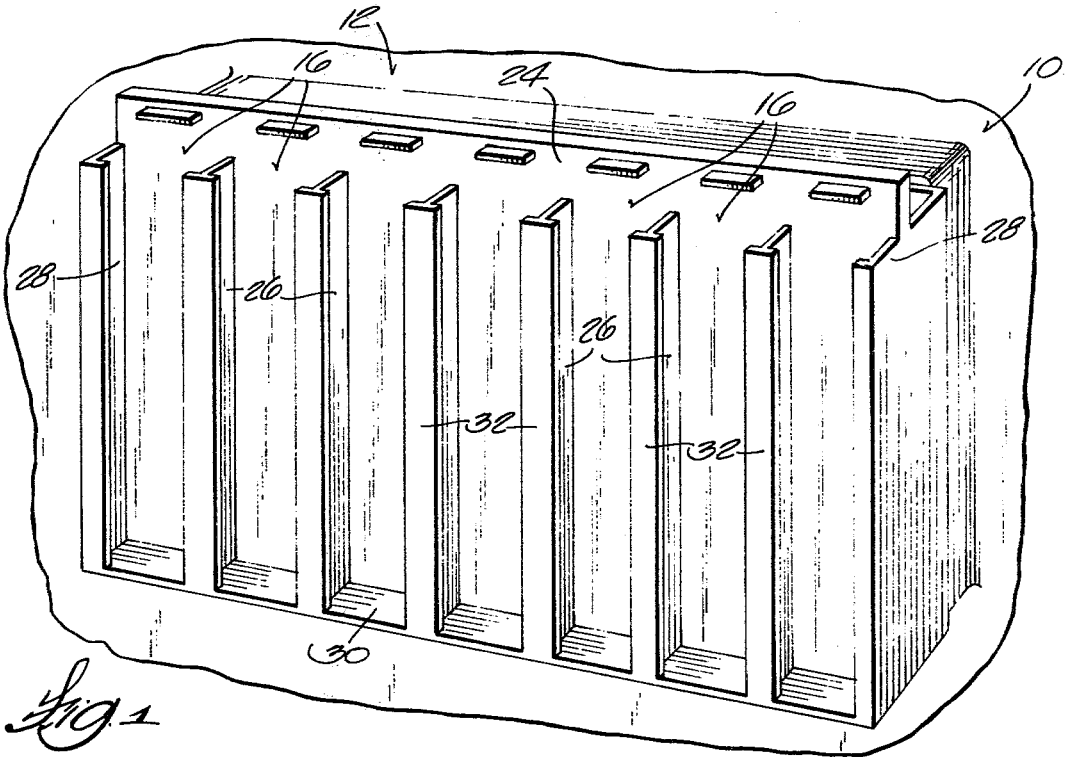
FIG. 1 is a perspective view of a display device embodying the present invention.

A display device 10 is shown in FIG. 1 and generally includes an upright rack or tray 12 intended to display and store a plurality of stacks of cards, the display rack 12 supported by a supporting wall 14. The cards displayed can, for example, comprise paint chip sample cards, and the display device is advantageously used in retail establishments and the like to clearly display a plurality of such cards and to permit access to the cards by customers.

Figure 2:
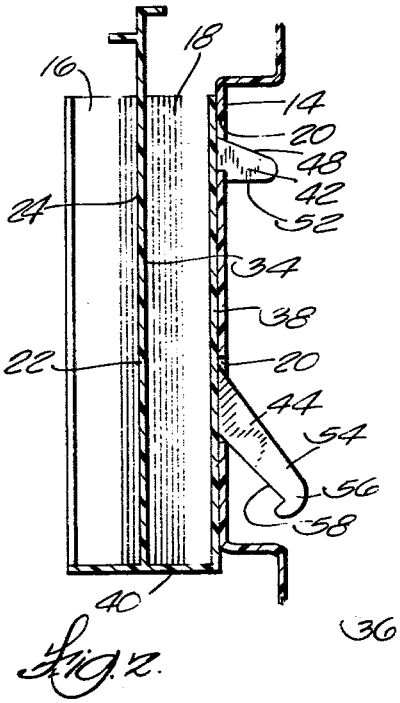
FIG. 2 is a cross-section end elevation view of the display device shown in FIG. 1.
Figure 3:
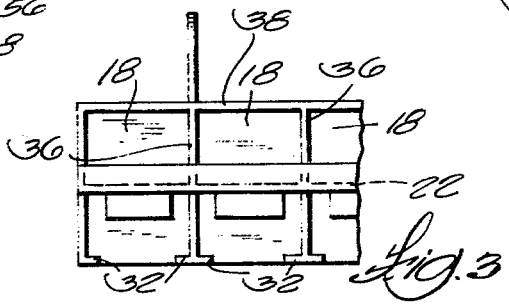
FIG. 3 is a partial plan view of the display rack of the display device shown in FIG. 1.
Figure 4:
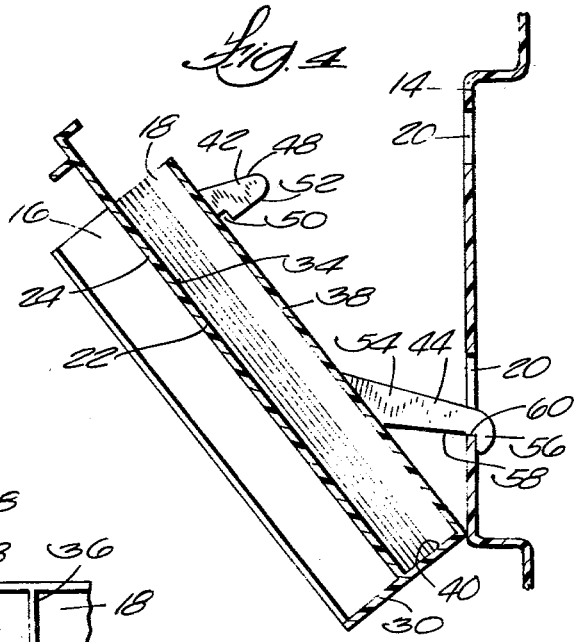
FIG. 4 is a cross-section end elevation view similar to FIG. 2 but showing the display rack forwardly inclined.

Generally, the display rack 12 includes a plurality of side-be-side narrow generally vertical compartments 16 on the front face thereof, each of the compartments 16 intended to hold a stack of cards supported in vertical relation and intended to facilitate removal of the cards by consumers. The compartments have an open front face to facilitate visibility of cards positioned in the display compartments, and the compartments 16 are open at the top to permit removal of cards stored therein. As shown in FIGS. 2 through 4, the display rack 12 also includes a plurality of side-by-side narrow vertical card storage compartments 18 on its rearward surface intended to store supplemental paint chip cards or the like to be used to replace the stacks of cards in the display compartments 16 when those compartments have been emptied. To facilitate access to the card storage compartments 18, the display rack is supported such that the upper portion of the display rack may be pulled forwardly away from the supporting wall 14, and the storage compartments 18 are open at the top to permit removal of cards therefrom. In one preferred embodiment, the display rack 12 is constructed from transparent plastic. However, other materials could also be employed and are within the scope of the invention.

The vertical wall 14 illustrated in FIGS. 1, 2 and 4 includes four rectangular apertures 20 therein (two shown), the apertures 20 being respectively located in a rectangular pattern comprising a pair of upper apertures and a pair of lower apertures, each of the upper apertures spaced above one of the lower apertures.

Display rack 12 includes a planar dividing wall 22 having a front face 24 supporting a plurality of spaced vertical compartment partitions 26, a pair of end walls 28, and a bottom wall 30 extending from the lower edge of the front face 24 of the planar dividing wall 22.

The vertical partitions 26 each extend forwardly and generally perpendicularly to the planar dividing wall 22 and include generally transverse ribs or elongated card restraining flanges 32 along each side of their forward edge, the ribs 32 of adjacent partitions 26 mutually extending toward each other and functioning to restrain cards in the compartments 16 defined between the partitions 26. In an alternative embodiment, the ribs 32 could be deleted and the partitions 26 could be joined by a continuous front wall.

The rear face 34 of the planar dividing wall 22 supports the plurality of side-by-side vertical card storage compartments 18. The storage compartments 18 are comprised of a plurality of parallel spaced vertical partitions 36 perpendicular to and extending rearwardly from the rear face 34 of the planar wall 22 and a rear planar wall 38 connected to each of the rearward edges of the parallel vertical partitions 36. The storage compartments 18 also have a bottom wall 40 adjacent the lower edge of the planar wall 22. The storage compartments 18 are open at the top to permit removal of cards therefrom.

The display rack is attached to the planar wall by a pair of rearwardly extending tabs 42 (one shown) and a pair of rearwardly extending hooks 44 (one shown). The tabs 42 extend from the planar wall 38 adjacent the top of that wall and are receivable in the upper pair of spaced apertures 20. The tabs 42 are provided with a downwardly sloping upper surface 48 and a notch 50 in their lower surface 52 adjacent the planar wall 38. The notch 50 is intended to engage the vertical wall 14 of the supporting structure to hold the display tray 12 against the vertical wall 14.

The hooks 44 are horizontally or laterally spaced and are integrally attached to the rear planar wall 38 below the tabs 42, respectively, but upwardly from the lower edge of the display rack. The hooks 44 each extend generally downwardly and rearwardly from the rear planar wall 38 and respectively extend through the lower pair of apertures 20 in the wall 14. The hooks 44 each include an elongated portion 54 having opposite ends, one of the opposite ends integrally attached to the rear planar wall 38 and the other of the opposite ends supporting a hook portion 56 which extends downwardly and generally perpendicualr to the elongated portion 54. The elongated portion 54 includes a generally linear downwardly and rearwardly extending lower edge 58 intended to be supported by a lower edge 60 of aperture 20.

It is anticipated that during use of the display device, the cards contained in the display compartments 16 will be removed and replacement will be required from the cards containd in the storage compartments 18. Access to the cards contained in the storage compartments 18 is provided by lifting the display case sufficiently to release the lower edge of the upper pair of apertures 20 from the notches 50, to thereby permit removal of the tabs from the upper apertures 20. The upper portion of the display tray 12 can then be pulled forwardly. The display tray 12 can then be supported in the forwardly inclined position shown in FIG. 4 by the lower portion of the display tray 12 positioned against the vertical face of the wall 14 and the hook portions 56 of the hook 44 engaging the rear face of the wall 14 to limit forward tilting movement.

I claim:

1. A display device for storing and displaying a plurality of cards, said display device comprising:

a supporting structure including a generally vertical wall;

a display rack supported by said vertical wall and having an upper portion and a lower portion, said display rack including a planar dividing wall having a front face and a rear face, a plurality of adjacent display compartments supported by said front face, and a plurality of storage compartments supported by said rear face for supporting cards therein; and means for supporting said display rack in a first position adjacent said vertical wall, and a second forwardly inclined position wherein the upper portion of said display rack is spaced from said vertical wall and the lower portion is positioned adjacent the vertical wall, said supporting means including at least one hook projecting rearwardly from said display rack and engageable with said vertical wall when said display rack is in said second position.

2. A display device as set forth in claim 1 wherein said vertical wall includes at least one aperture therethrough and wherein said hook extends through said aperture, and wherein said hook is attached to a lower portion of said display rack and is inclined rearwardly and downwardly.

3. A display device as set forth in claim 2 wherein said hook includes an arm portion attached to said display rack, said arm portion inclined downwardly and rearwardly, said arm portion including a free end extending through said aperture, and a transverse wall engaging portion attached to said free end of said arm portion for engaging said vertical wall when said display rack is in said second position, said engaging portion extending downwardly and transversely with respect to said arm portion.

4. A display device as set forth in claim 3 wherein said vertical face includes at least a pair of vertically spaced apertures therein including an upper aperture and a lower aperture and wherein said tray supporting means includes a projection extending rearwardly from said tray and spaced upwardly from said hook, said projection positioned in said upper aperture when said supporting means is in said first position and spaced from said vertical wall when said tray is in said second position, and said hook being positioned in said lower aperture.

5. A display device as set forth in claim 1 wherein said vertical face includes at least a pair of vertically spaced apertures therein including an upper aperture and a lower aperture and wherein said tray supporting means includes a projection extending rearwardly from said tray and spaced upwardly from said hook, said projection positioned in said upper aperture when said supporting means is in said first position and spaced from said vertical wall when said tray is in said second position, and said hook being positioned in said lower aperture.

6. A display device as set forth in claim 1 wherein said planar dividing wall has a lower edge, and wherein said display compartments include a plurality of spaced generally parallel partitions extending from said front face and a bottom wall extending forwardly from said planar dividing wall adjacent said lower edge for supporting cards thereon, and wherein said storage compartments include a plurality of spaced generally parallel partitions extending from said rear face and each having a rearward edge, a rear bottom wall extending from said lower edge of said planar dividing wall and extending rearwardly and for supporting cards thereon, and a rear wall in spaced generally parallel relation to said planar dividing wall and attached to said rearward edges, and wherein said hook is attached to said rear wall and projects rearwardly therefrom.

7. A display device as set forth in claim 6 wherein said partitions extending from said front face include an outer edge spaced from said planar wall and include ribs attached to said outer edges and transverse to said partitions.

8. A display rack for displaying a plurality of cards, said display rack comprising:

a planar dividing wall having a front face and a rear face and a lower edge;

a plurality of side-by-side display compartments supported by said front face, said display compartments defined by a plurality of spaced partitions each extending from said front face and being transverse to said front face and a bottom wall extending forwardly from said front face for supporting cards thereon;

a plurality of storage compartments supported by said rear face for supporting cards therein, said storage compartments defined by a plurality of spaced partitions extending transversely from said rear face and each having a rearward edge, a rearward bottom wall extending from said lower edge of said planar dividing wall and extending rearwardly and for supporting cards thereon, and a rear wall in spaced generally parallel relation to said planar dividing wall and attached to said rearward edges; and at least one hook attached to said rear wall and projecting downwardly and rearwardly therefrom, said hook including an arm portion attached to said rear wall and extending downwardly and rearwardly, and said arm portion including a free end supporting a hook portion extending transversely to said arm portion for supporting said display rack in a selected position.

* * * * *